US009708849B1

(12) United States Patent
Lin

(10) Patent No.: US 9,708,849 B1
(45) Date of Patent: Jul. 18, 2017

(54) CURTAIN ASSEMBLY

(71) Applicant: Ya-Yin Lin, Chiayi (TW)

(72) Inventor: Ya-Yin Lin, Chiayi (TW)

( * ) Notice: Subject to any disclaimer, the term of this patent is extended or adjusted under 35 U.S.C. 154(b) by 0 days.

(21) Appl. No.: 15/144,009

(22) Filed: May 2, 2016

(51) Int. Cl.
*E06B 9/262* (2006.01)
*E06B 9/30* (2006.01)

(52) U.S. Cl.
CPC ..... *E06B 9/262* (2013.01); *E06B 9/30* (2013.01); *E06B 2009/2622* (2013.01)

(58) Field of Classification Search
CPC ..... E06B 9/262; E06B 9/30; E06B 2009/2622
USPC ..... 160/84.01, 392
See application file for complete search history.

(56) References Cited

U.S. PATENT DOCUMENTS 2,797,750 A * 7/1957 Van Dette ..... E06B 9/52 108/24
5,566,735 A * 10/1996 Jelic ..... E06B 9/262 160/84.04
5,690,156 A * 11/1997 Ruggles ..... E06B 9/262 160/84.04
5,862,850 A * 1/1999 Yang ..... E06B 9/262 160/264
7,124,801 B2 * 10/2006 Ng ..... E06B 9/262 160/84.04
9,004,140 B2 * 4/2015 Hailes ..... E06B 9/262 160/405
2004/0108078 A1 * 6/2004 Chen ..... E06B 9/262 160/84.01
2006/0048902 A1 * 3/2006 Smith ..... A47H 13/00 160/84.01
2007/0000619 A1 * 1/2007 Ng ..... E06B 9/262 160/84.04
2016/0258210 A1 * 9/2016 Goldberg ..... E06B 9/384

FOREIGN PATENT DOCUMENTS

WO WO 2005044064 A1 * 5/2005

* cited by examiner

*Primary Examiner* — Blair M Johnson
(74) *Attorney, Agent, or Firm* — LeClairRyan

(57) ABSTRACT

A curtain assembly includes a curtain, a cord unit connected to the curtain and adjustable to raise or lower the curtain in an up-down direction, and a retaining unit. The retaining unit is detachably coupled to the curtain and includes an outer hollow member, an inner rod member, and a confining member. The outer hollow member extends in a lengthwise direction perpendicular to the up-down direction, has a surrounding wall formed with an opening, and has a receiving space defined by the surrounding wall. A part of the curtain surrounds the inner rod member, extends through the opening, and is fixed between the surrounding wall and the inner rod member. The cord unit extends through the confining member.

5 Claims, 7 Drawing Sheets

CURTAIN ASSEMBLY

FIELD

The disclosure relates to a curtain assembly.

BACKGROUND

Referring to FIG. 1, a conventional curtain assembly 1 includes a fixing unit 11, a curtain 12, a plurality of rods 13, a plurality of rings 14 and a cord unit 15. The fixing unit 11 includes a cord guiding member (not shown). The curtain 12 has a lower end 121, an upper end 122 opposite to the lower end 121 in a vertical direction (V), a plurality of retaining portions 123, and a plurality of middle portions 124. The upper end 122 is connected to the fixing unit 11. The retaining portions 123 are formed by sewing, are arranged between the lower and upper ends 121, 122 in the vertical direction (V), and are connected to the middle portions 124. Each of the rods 13 is inserted in a respective one of the retaining portions 123 of the curtain 12. Each of the rings 14 is connected to a corresponding one of the retaining portions 123. The lowest one of the middle portions 124 is disposed between the lower end 121 and the lowest one of the retaining portions 123. The highest one of the middle portions 124 is disposed between the fixing unit 11 and the highest one of the retaining portions 123. The remaining middle portions 124 are disposed between corresponding two of the retaining portions 123. Each of the middle portions 124 has opposite lower and upper segments in the vertical direction (V). The cord unit 15 has two first cord portions 151, and a second cord portion 152 that is connected to the cord guiding member of the fixing unit 11. Each of the first cord portions 151 of the cord unit 15 interconnects the lower end 121 of the curtain 12 and the cord guiding member of the fixing unit 11, and extends through corresponding ones of the rings 14.

The second cord portion 152 of the cord unit 15 is operable to raise or lower the curtain 12. When the second cord portion 152 is operated to raise the curtain 12, the first cord portions 151 are gradually wound on the cord guiding member of the fixing unit 11 at the same moment that the lower end 121 is pulled toward the upper end 122 of the curtain 12. When the lower segment of each of the middle portions 124 is raised to reach the position where the adjacent one of the rods 13 is located, a folded part 125 of the middle portion 124 is defined.

When wishing to change the vertical length of the folded part 125 of the curtain 12, the curtain assembly 1 would have to be redesigned and remade to have different numbers of the retaining portions 123, resulting in higher manufacturing costs.

SUMMARY

Therefore, an object of the present disclosure is to provide a curtain assembly that can alleviate the drawback associated with the prior art.

According to the present disclosure, the curtain assembly includes a curtain, a cord unit and a retaining unit.

The cord unit is connected to the curtain and is adjustable to raise or lower the curtain in an up-down direction. The retaining unit is detachably coupled to the curtain, and includes an outer hollow member, an inner rod member and a confining member. The outer hollow member extends in a lengthwise direction perpendicular to the up-down direction, and has a surrounding wall and a receiving space. The receiving space is defined by the surrounding wall and is formed with an opening in the surrounding wall along the lengthwise direction. The inner rod member is detachably inserted in the receiving space of the outer hollow member. A part of the curtain surrounds the inner rod member, extends through the opening, and is fixed between the surrounding wall of the outer hollow member and the inner rod member. The confining member is disposed on the surrounding wall of the outer hollow member. The cord unit extends through the confining member.

BRIEF DESCRIPTION OF THE DRAWINGS

Other features and advantages of the present disclosure will become apparent in the following detailed description of the embodiments with reference to the accompanying drawing, of which.

DETAILED DESCRIPTION

Figure 1:
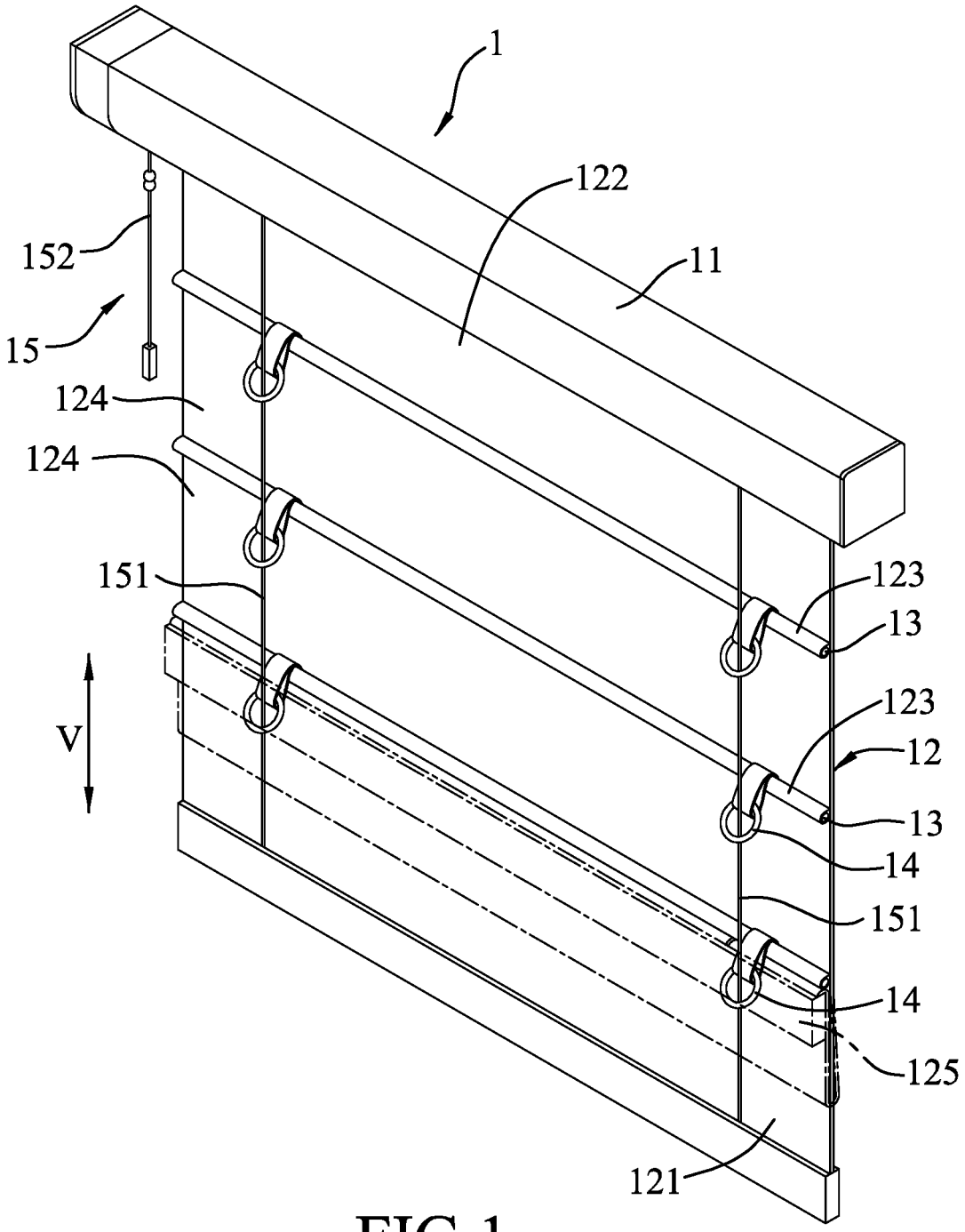
FIG.1 PRIOR ART
FIG. 1 is a schematic perspective view of a conventional curtain assembly.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
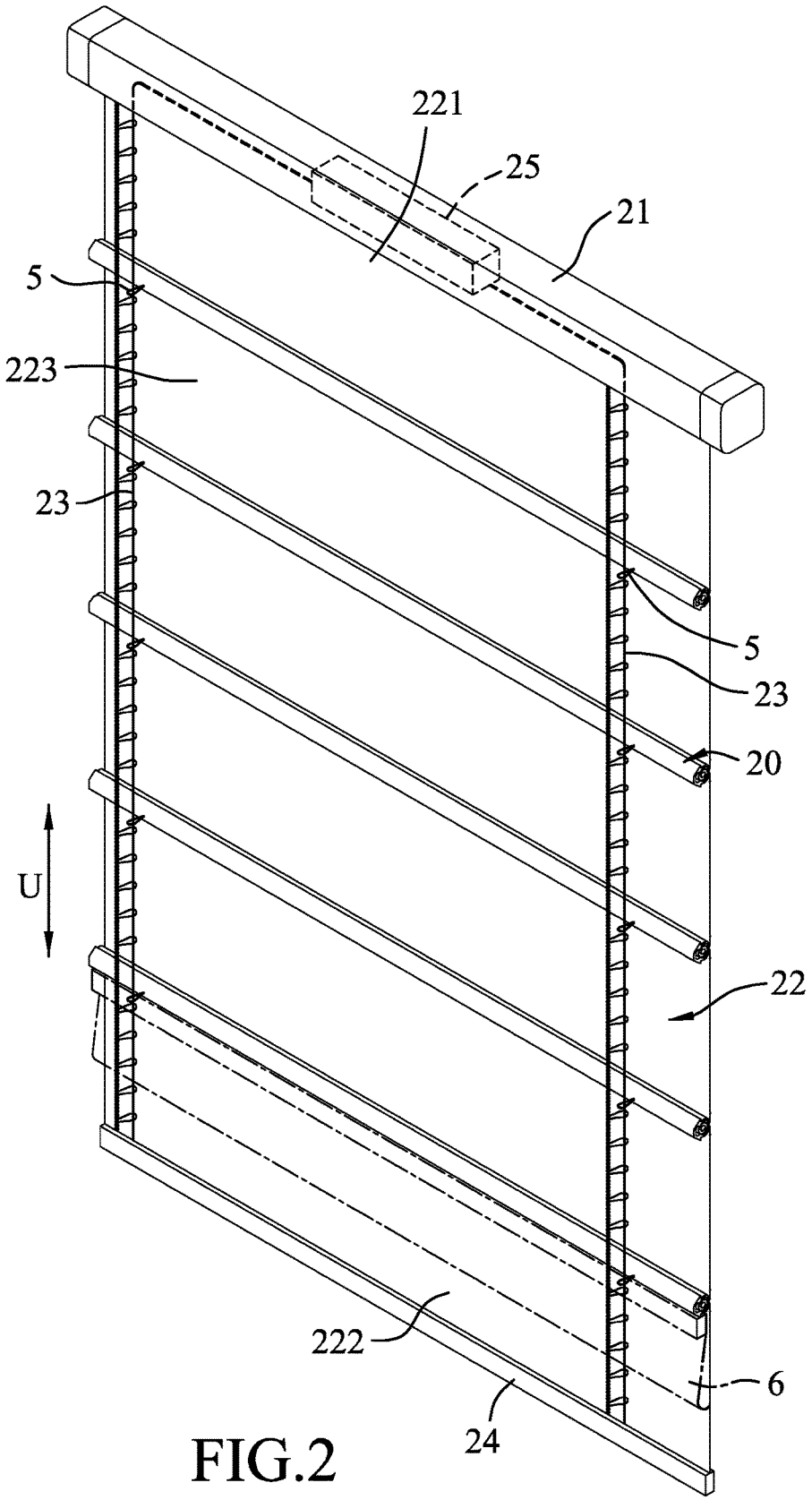
FIG. 2 is a schematic perspective view of a first embodiment of a curtain assembly according to the present disclosure.

Referring to FIG. 2, a first embodiment of a curtain assembly according to the present disclosure includes a fixing unit 21, a spring rewind reel 25 received in the fixing unit 21, a curtain 22, two cord units 23, a lower plate 24 and a plurality of retaining units 20.

The cord units 23 are connected to the curtain 22 and are adjustable to raise or lower the curtain 22 in an up-down direction (U). To be more specific, the curtain 22 has an upper portion 221, a lower portion 222, and a middle portion 223 interconnecting the upper and lower portions 221, 222. The upper portion 221 of the curtain 22 is connected to the fixing unit 21. The lower plate 24 is connected to the lower portion 222 of the curtain 22. The retaining units 20 are detachably coupled to the middle portion 223 of the curtain 22, and are arranged in the up-down direction (U). Each of the retaining units 20 includes two confining members 5 through which the cord units 23 respectively extend. The spring rewind reel 25 is operable to collect or release the cord units 23, and therefore controls the raising or lowering of the curtain 22. Since the operation of the cord units 23 and the spring rewind reel 25 is well known, details thereof are not further described. Moreover, for the sake of brevity, only one retaining unit 20, one confining member 5 and one cord unit 23 are described hereinafter.

Figure 3:
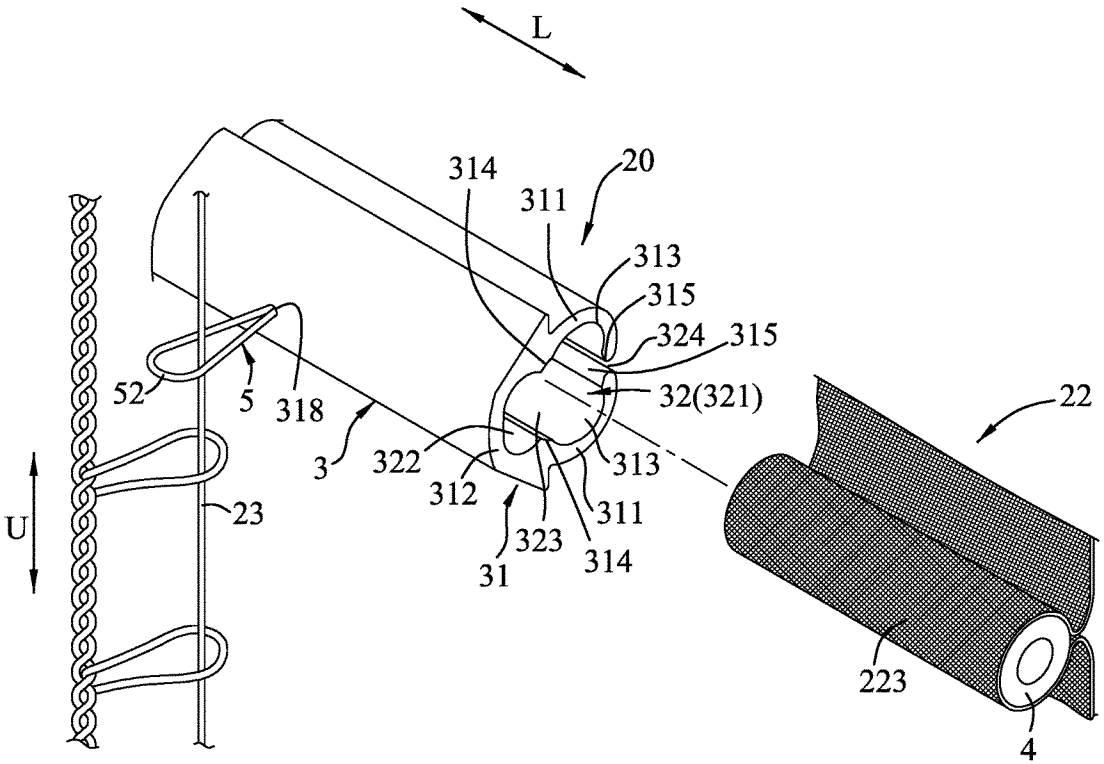
FIG. 3 is a partly and fragmentary exploded view, illustrating a curtain and a retaining unit of the first embodiment.
Figure 4:
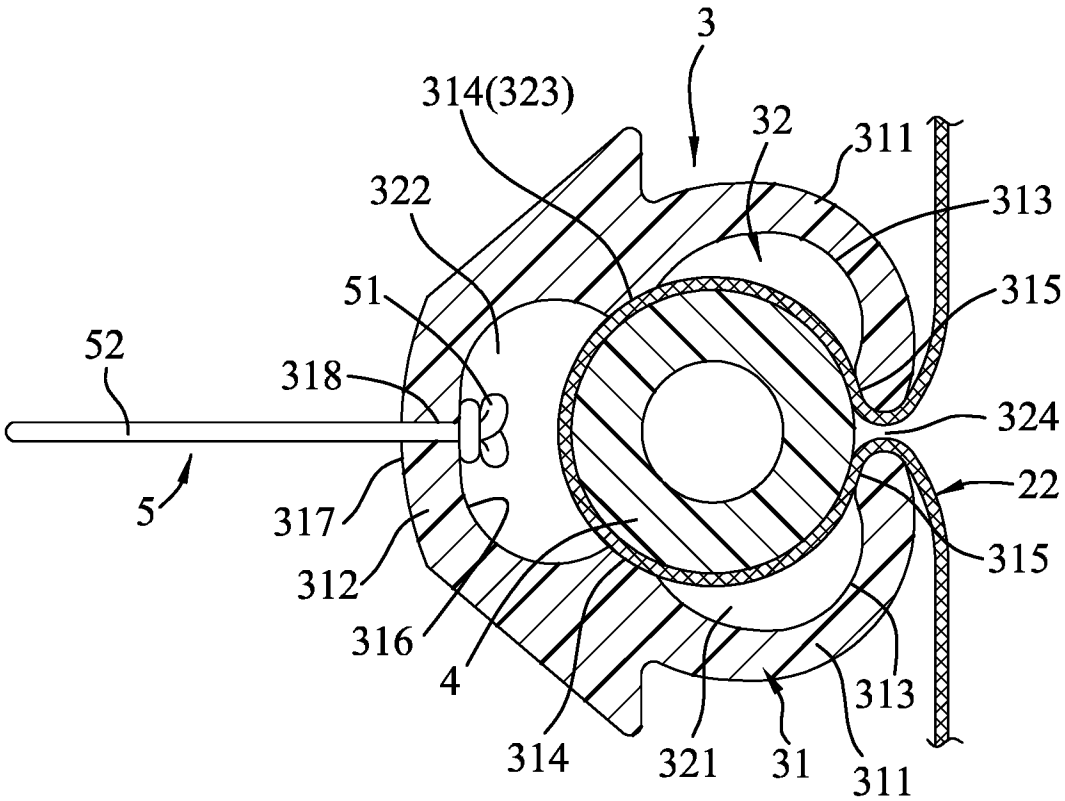
FIG. 4 is a partly and fragmentary cross-sectional view, illustrating the curtain and the retaining unit of the first embodiment.

Referring to FIGS. 3 and 4, the retaining unit 20 further includes an outer hollow member 3 and an inner rod member 4. The outer hollow member 3 extends in a lengthwise direction (L) perpendicular to the up-down direction (U), and has a surrounding wall 31 and a receiving space 32. The receiving space 32 is defined by the surrounding wall 31 and is formed with an opening 324 in the surrounding wall 31 along the lengthwise direction (L). The inner rod member 4 is detachably inserted in the receiving space 32 of the outer hollow member 3 in the lengthwise direction (L). A part of the middle portion 223 of the curtain 22 surrounds the inner rod member 4, extends through the opening 324, and is removably fixed between the surrounding wall 31 of the outer hollow member 3 and the inner rod member 4. In this embodiment, the surrounding wall 31 of the outer hollow member 3 presses the part of the middle portion 223 of the curtain 22 against the inner rod member 4 such that the part of the middle portion 223 of the curtain 22 is removably fixed between the outer hollow member 3 and the inner rod member 4. The confining member 5 is disposed on the surrounding wall 31 of the outer hollow member 3. The inner rod member 4 may be a hollow tube or a solid rod, and may be changed according to practical requirements.

To be more specific, the surrounding wall 31 has two surrounding segments 311 that cooperatively define the opening 324, and a connecting segment 312 that interconnects the surrounding segments 311. Each of the surrounding segments 311 has an inner surface that faces the inner rod member 4 and that has a first abutment region that is proximate to the connecting segment 312, a second abutment region that is distal from the connecting segment 312 and that is proximate to the opening 324, and an expanding region that interconnects the first and second abutment regions, and that is spaced apart from the inner rod member 4 and the part of the middle portion 223 of the curtain 22 surrounding the inner rod member 4.

In one embodiment, each of the surrounding segments 311 of the surrounding wall 31 further has a first abutment portion 314, a second abutment portion 315 and an expanding portion 313 interconnecting the first abutment portion 314 and the second abutment portion 315. The first abutment portion 314 is proximate to the connecting segment 312 and is formed with the first abutment region. The second abutment portion 315 is distal from the connecting segment 312, is proximate to the opening 324, and is formed with the second abutment region. The expanding portion 313 is formed with the expanding region, and is thus spaced apart from the inner rod member 4 and the part of the middle portion 223 of the curtain 22 surrounding the inner rod member 4. The first abutment portion 314 and the second abutment portion 315 of one of the surrounding segments 311, and the first abutment portion 314 and the second abutment portion 315 of the other one of the surrounding segments 311 cooperatively press the part of the middle portion 223 of the curtain 22 against the inner rod member 4.

In one embodiment, the receiving space 32 of the outer hollow member 3 may be divided into a first room 321 and a second room 322. The first room 321 is defined by the inner surfaces of the surrounding segments 311. The second room 322 is defined by an inner surface 316 of the connecting segment 312. The first room 321 is in spatial communication with the second room 322 and the opening 324, and has a contracted neck area 323 adjacent to the second room 322. The contracted neck area 323 is defined by the first abutment portions 314 of the surrounding segments 311. The inner rod member 4 is mainly located in the first room 321 and partially extends into the second room 322 (see FIG. 4). In this embodiment, the inner rod member 4 is shaped as a hollow cylinder and has a maximum diameter that is perpendicular to the lengthwise direction (L). The maximum diameter is larger than a distance between the first abutment portions 314 of the surrounding segments 311 perpendicular to the lengthwise direction (L), and is larger than a distance between the second abutment segments 315 of the surrounding segments 311 perpendicular to the lengthwise direction (L).

In this embodiment, the connecting segment 312 of the surrounding wall 31 further has an outer surface 317 opposite to the inner surface 316, and is formed with a through hole 318 extending through the inner and outer surfaces 316, 317. The through hole 318 may be circular in shape.

The confining member 5 includes a mounting segment 51, and a confining segment 52 that extends through and that is exposed from the outer hollow member 3. The cord unit 23 extends through the confining segment 52, and is therefore prevented from being separated from the confining member 5. The mounting segment 51 is connected to the confining segment 52 and is disposed in the second room 322 of the receiving space 32 for retaining the confining member 5 on the outer hollow member 3.

In one embodiment, the confining member 5 is a rope, the mounting segment 51 of the confining member 5 is a knot, and the confining segment 52 of the confining member 5 is a loop body.

Figure 5:
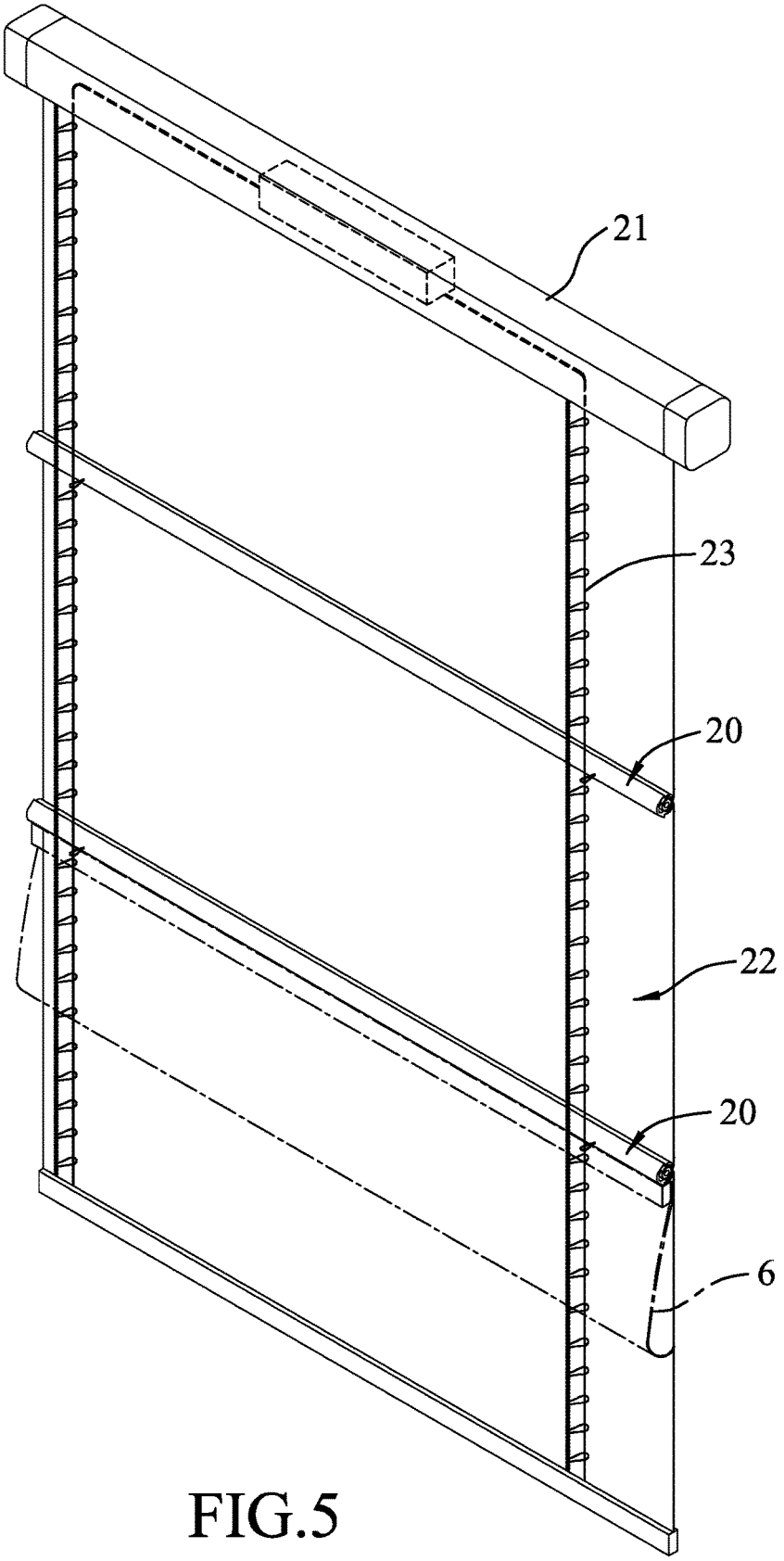
FIG. 5 is a schematic perspective view illustrating a variation of the first embodiment which includes fewer retaining units.

In this disclosure, the number of the retaining unit 20 coupled to the middle portion 223 of the curtain 22 may vary based on actual requirements so as to adjust the length of a folded part 6 of the curtain 22 (see FIGS. 2 and 5) when raised. In a variation of the first embodiment (see FIG. 5), the number of the retaining unit 20 is two.

Figure 6:
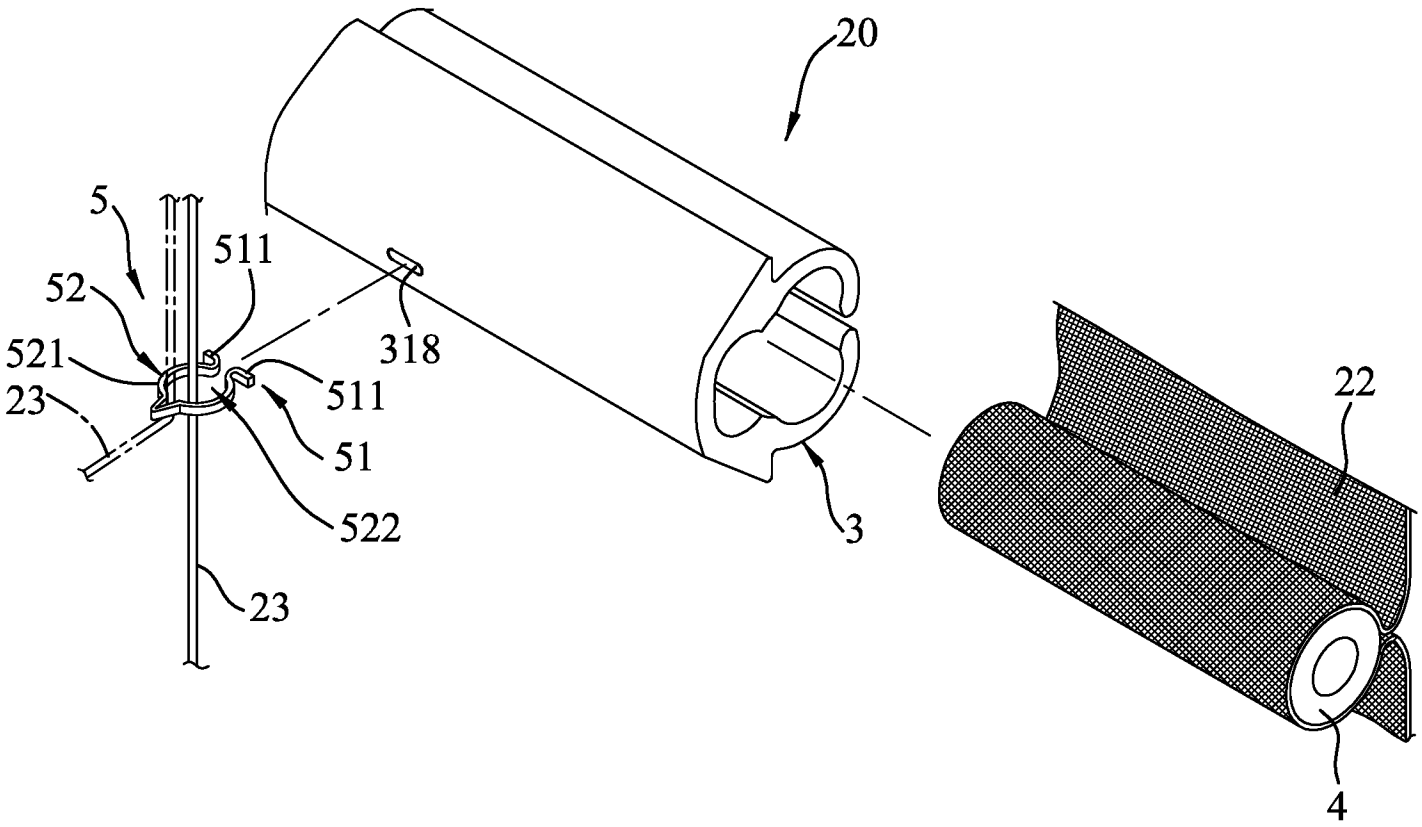
FIG. 6 is a view similar to FIG. 3, but illustrating a second embodiment of this disclosure.
Figure 7:
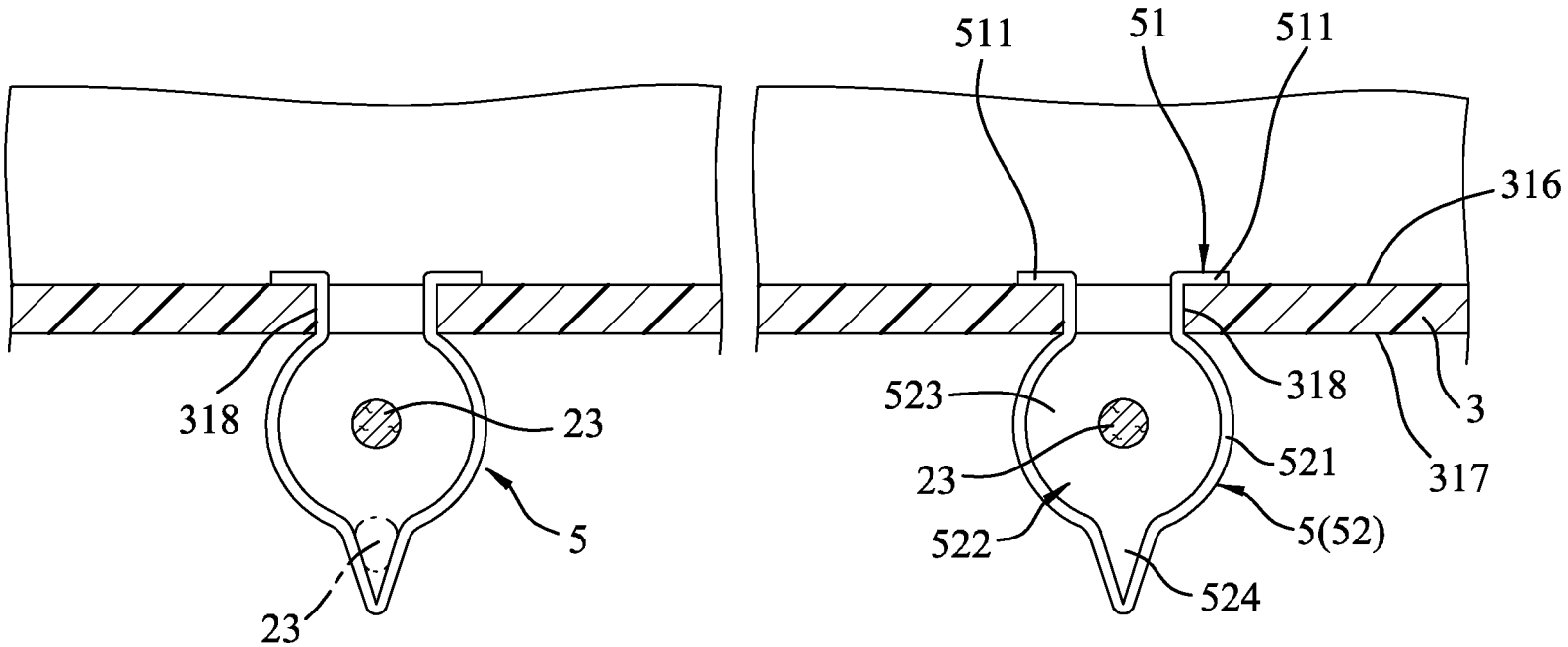
FIG. 7 is a partly and fragmentary cross-sectional view of the second embodiment.

Referring to FIGS. 6 and 7, a second embodiment of the curtain assembly of this disclosure has a structure similar to that of the first embodiment. Therefore, only the differences are described hereinafter for the sake of brevity.

In the second embodiment, the mounting segment 51 of the confining member 5 has two abutting portions 511 that abut against the surrounding wall 31. The confining segment 52 has a confining portion 521 and a confining space 522 that is defined by the confining portion 521. The cord unit 23 extends through the confining space 522. The abutting portions 511 of the mounting segment 51 and the confining portion 521 of the confining segment 52 are formed as one piece, and may be made of metal or plastic.

In one embodiment, the confining space 522 of the confining segment 52 has an enlarged region 523 adjacent to the outer hollow member 3, and a constricted region 524 away from the outer hollow member 3. The enlarged region 523 permits adjustment of the cord unit 23 to raise or lower the curtain 22 when the cord unit 23 passes through the enlarged region 523. The constricted region 524 restricts adjustment of the cord unit 23 to raise or lower the curtain 22 when the cord unit 23 is pulled away from the curtain 22 and passes through the constricted region 524.

In assembly of the curtain assembly of this disclosure, a user may choose adequate numbers of the retaining units 20 to be coupled to the middle portion 223 of the curtain 22. For each of the retaining units 20, the confining segments 52 of the confining members 5 respectively extend through the assembling holes 318 of the outer hollow member 3 from the receiving space 32. Then the part of the middle portion 223 of the curtain 22 surrounds the inner rod member 4, followed by inserting the inner rod member 4 together with the part of the middle portion 223 of the curtain 22 into the receiving space 32 of the outer hollow member 3 in the lengthwise direction (L) with the part of the middle portion 223 extending through the opening 324. Next, the cord units 23 respectively extend through the confining segments 52 of the confining members 5 that are exposed from the outer hollow member 3.

It is worth mentioning that, in each of the retaining units 20, the purpose of forming the expanding portion 313 that is spaced apart from the part of the middle portion 223 of the curtain 22 and the inner rod member 4 is to reduce the friction between the surrounding wall 31 and the part of the middle portion 223 of the curtain 22 when inserting the part of the middle portion 223 of the curtain 22 and the inner rod member 4 into the receiving space 32 of the outer hollow member 3 or removing the same from the receiving space 32 of the outer hollow member 3. The first abutment region of the first abutment portion 314 and the second abutment region of the second abutment portion 315 of each of the surrounding segments 311 of the surrounding wall 31 may provide sufficient friction force to maintain the part of the middle portion 223 of the curtain 22 and the inner rod member 4 in the receiving space 32 of the outer hollow member 3.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment (s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A curtain assembly comprising:

a curtain;

a cord unit that is connected to said curtain and that is adjustable to raise or lower said curtain in an up-down direction; and a retaining unit that is detachably coupled to said curtain and that includes an outer hollow member, an inner rod member and a confining member, said outer hollow member extending in a lengthwise direction perpendicular to the up-down direction, and having a surrounding wall and a receiving space, said receiving space being defined by said surrounding wall and being formed with an opening in said surrounding wall along the lengthwise direction, said inner rod member being detachably inserted in said receiving space of said outer hollow member, a part of said curtain surrounding said inner rod member, extending through said opening, and being fixed between said surrounding wall of said outer hollow member and said inner rod member, said confining member being disposed on said surrounding wall of said outer hollow member, said cord unit extending through said confining member, wherein said surrounding wall of said outer hollow member is formed with a through hole, said confining member including a mounting segment and a confining segment that extends through and that is exposed from said through hole, said cord unit extending through said confining segment, said mounting segment being connected to said confining segment and being disposed in said receiving space of said outer hollow member for retaining said confining member on said outer hollow member, and wherein said confining member is a rope, said mounting segment of said confining member being a knot, said confining segment of said confining member being a loop body.

2. The curtain assembly as claimed in claim 1, wherein said surrounding wall of said outer hollow member presses said part of said curtain against said inner rod member such that said part of said curtain is fixed between said outer hollow member and said inner rod member.

3. The curtain assembly as claimed in claim 2, wherein said surrounding wall has two surrounding segments that cooperatively define said opening, and a connecting segment that interconnects said surrounding segments, each of said surrounding segments having a first abutment portion proximate to said connecting segment, and a second abutment portion distal from said connecting segment and proximate to said opening, said first abutment portion and said second abutment portion of one of said surrounding segments, and said first abutment portion and said second abutment portion of the other one of said surrounding segments cooperatively pressing said part of said curtain against said inner rod member.

4. The curtain assembly as claimed in claim 3, wherein each of said surrounding segments further has an expanding portion that interconnects said first abutment portion and said second abutment portion and that is spaced apart from said part of said curtain and said inner rod member.

5. The curtain assembly as claimed in claim 1, wherein said curtain assembly comprises a plurality of said retaining units arranged in the up-down direction.

* * * * *